US008460767B2

(12) United States Patent
van der Zwan et al.

(10) Patent No.: US 8,460,767 B2
(45) Date of Patent: Jun. 11, 2013

(54) COMPRESSIBLE DECORATIVE PAPER IMPREGNATING AGENT WHICH CAN BE PRINTED BY THE INKJET METHOD

(75) Inventors: Rijk van der Zwan, Bad Iburg (DE); Stefan Strunk, Wallenhorst (DE)

(73) Assignee: Schoeller Technocell GmbH & Co. KG, Osnabruck (DE)

( * ) Notice: Subject to any disclaimer, the term of this patent is extended or adjusted under 35 U.S.C. 154(b) by 216 days.

(21) Appl. No.: 12/808,916

(22) PCT Filed: Dec. 17, 2008

(86) PCT No.: PCT/EP2008/067746

§ 371 (c)(1),
(2), (4) Date: Jul. 26, 2010

(87) PCT Pub. No.: WO2009/077561

PCT Pub. Date: Jun. 25, 2009

(65) Prior Publication Data

US 2010/0282407 A1 Nov. 11, 2010

(30) Foreign Application Priority Data

Dec. 17, 2007 (EP) ..... 07123355

(51) Int. Cl.
*B41M 5/40* (2006.01)

(52) U.S. Cl.
USPC ..... 428/32.18; 428/32.21; 428/32.28; 428/32.34

(58) Field of Classification Search
CPC ..... B41M 5/508; B41M 5/5218; B41M 5/52; B41M 5/5254
USPC ..... 428/32.18, 32.21, 32.28, 32.34
See application file for complete search history.

(56) References Cited

U.S. PATENT DOCUMENTS

| | | | | |
|---|---|---|---|---|
| 2003/0039810 | A1* | 2/2003 | Schulz et al. | 428/195 |
| 2006/0134405 | A1* | 6/2006 | Dohring | 428/342 |

FOREIGN PATENT DOCUMENTS

| | | | |
|---|---|---|---|
| DE | 19728250 | | 1/1999 |
| DE | 19916546 | | 10/2000 |
| EP | 0421140 | | 4/1991 |
| EP | 0631880 | | 1/1995 |
| EP | 0806522 | A | 11/1997 |
| EP | 0947348 | | 10/1999 |
| EP | 01044822 | | 10/2000 |
| EP | 1176255 | | 1/2002 |
| EP | 1584666 | | 10/2005 |
| EP | 01757731 | | 2/2007 |
| EP | 0964956 | | 5/2009 |
| GB | 1108549 | | 4/1968 |
| GB | 1142673 | | 2/1969 |
| GB | 1421210 | | 1/1976 |
| WO | WO93/00209 | | 1/1993 |
| WO | WO94/00523 | | 1/1994 |
| WO | WO95/17551 | | 6/1995 |
| WO | WO01/11139 | | 2/2001 |
| WO | WO 2006/002761 | | 1/2006 |
| WO | WO 2007/000420 | | 1/2007 |
| WO | WO 2007/144718 | | 12/2007 |

OTHER PUBLICATIONS

Das Papier, Issue 12 (1980), pp. 575-579.
International Search Report for PCT/EP2008/060712, Mar. 3, 2009.

* cited by examiner

*Primary Examiner* — Betelhem Shewareged
(74) *Attorney, Agent, or Firm* — Honigman Miller Schwartz and Cohn LLP; Thomas A. Wootton; Jonathan P. O'Brien

(57) ABSTRACT

The invention relates to a decorative paper impregnate which can be pressed into a laminate for decorative coating materials, which is impregnated with an impregnating resin and provided with an ink receiving layer and which after drying has a residual moisture of at least 3.5% and a flow of more than 0.4%.

8 Claims, No Drawings

COMPRESSIBLE DECORATIVE PAPER IMPREGNATING AGENT WHICH CAN BE PRINTED BY THE INKJET METHOD

This application is the U.S. National phase of PCT Application No. PCT/EP2008/067746, filed, Dec. 17, 2008, which claims the priority of European Application No. EP 07 123 355.5, filed Dec. 17, 2007. Both of these documents are incorporated herein in their entirety.

The invention relates to a decorative paper impregnate which is impregnated with a thermally curable impregnating resin and which can be printed by means of ink jet methods, wherein after printing the impregnated decorative paper can be pressed directly with a wood material to form a laminate.

Decorative papers are required for the production of decorative laminates which are used as building materials in furniture manufacture and in interior finishing. Decorative laminates principally comprise so-called high-pressure laminates (HPL) and low-pressure laminates (LPL). For the production of a high-pressure laminate the decorative paper in the unprinted or printed state is impregnated with a resin and is pressed with one or more layers of kraft paper sheets which have been impregnated in phenol resin (core papers) in a laminating press at a temperature of about 110 to 170° C. and a pressure of 5.5 to 11 MPa. The laminate (HPL) thus formed is then glued or adhered with a support material such as HDF or chipboard. A low-pressure laminate is produced by pressing the unprinted or printed decorative paper impregnated with a resin directly with the supporting board at a temperature of 160 to 200° C. and a pressure of 1.25 to 3.5 MPa.

The finishing of the material surfaces can be of a visual nature (by appropriate colouring) and/or of a physical nature (by coating the board surface with appropriate functionality and structure). Decorative papers can be processed with or without a printed-on pattern. For this purpose the printed or unprinted decorative paper is usually impregnated with synthetic resins in a single-stage or multi-stage process, then dried, wherein the resin still remains reactive and is then irreversibly hot pressed with a support material into sheets or as rolled goods. The resin cures during the pressing. Due to this curing not only the bond to the board is produced but the paper is completely sealed chemically and physically.

The application of the printing pattern is usually accomplished in a gravure printing method. Particularly during the production of printing patterns which are customary in the market, this printing technique has the advantage of printing large quantities of paper at high machine speed.

However, the gravure printing method should be assessed as not being cost-effective for smaller quantities and inadequate in regard to printing quality in the case of complex designs. Among the printing techniques which meet the requirements for flexibility and quality, the ink jet printing method (ink jet) is acquiring increasing importance.

In order to make decorative papers printable by means of ink jet, these are coated with one or several functional layers to receive the inks and fix the dyes. Such a decorative paper which can be printed by the ink jet method is described in DE 199 16 546 A1.

An ink-jet printable decorative paper can be impregnated with thermosetting resins after printing and then hot pressed. Since the paper is frequently only printed in sheets up to several linear metres long, e.g. 3.5 metres, impregnation in an impregnating system is frequently not possible. In this case, the sheet is pressed between highly resin-impregnated papers. During the pressing process the resin penetrates into the decorative paper and cures. The result is a good-quality laminate. Compared to an impregnating system, however, this procedure does not ensure that the decorative paper is uniformly through-impregnated. Consequently, complete sealing of the paper is not achieved in this process.

When pressing the decorative paper between the resin-impregnated papers, it is advantageous that only the decorative paper that has been printed is pressed. If the decorative paper is printed as a roll and subsequently impregnated, losses of material occur caused by foreruns in the systems, printing and cutting transitions and process adjustments. High-quality material is therefore lost.

It is the object of the invention to provide a decorative paper which does not have the disadvantages described above.

The object is achieved by a decorative paper impregnate which contains an impregnated base paper (decorative base paper) and an ink receiving layer, wherein the base paper contains an impregnating resin in a quantity of 40 to 250% by weight of the basis weight of the base paper, and after drying the decorative paper impregnate has a residual moisture of at least 3.5% by weight and a flow of more than 0.4%, measured at a pressure of 180 bar and a temperature of 143±2° C.

In a particular embodiment of the invention, the quantity of the impregnating resin is 80 to 125% by weight of the basis weight of the base paper.

The residual moisture of the decorative paper after drying is preferably 5 to 8.5%.

The effect according to the invention is achieved in particular if the decorative base paper is initially core-impregnated, pre-dried and only afterwards coated with one or more ink-receiving layers in a coating process and dried. It should be noted in this case that after pre-drying the core-impregnated base paper and drying the finished decorative paper impregnate, the impregnating resin is not cured and therefore remains reactive.

The term "not cured" in the sense of the invention means that the impregnating resin has a degree of cross-linking of at most 65%, preferably of at most 30%. The method for determining the degree of cross-linking is described in detail in the further text.

The method for producing the decorative paper impregnate according to the invention is characterised by the following steps:

(a) fabricating a decorative base paper with a basis weight of 30 to 200 g/m$^2$, (b) core-impregnating the decorative base paper with a thermally curable impregnating resin in a quantity of 40 to 250% by weight of the basis weight of the base paper, (c) pre-drying the core-impregnated paper, wherein the drying temperature is adjusted so that the paper has a moisture of 9 to 20% and the resin is not cured and therefore still reactive.

(d) Coating the pre-dried core-impregnated paper with at least one ink-receiving layer, (e) Drying the core-impregnated decorative paper provided with at least one ink-receiving layer to a residual moisture of 3.5 to 8.5%, wherein the resin is cross-linked at most to a degree of cross-linking of 30% and therefore still reactive and the dried decorative paper impregnate produced has a flow of more than 0.4% measured at a pressure of 180 bar and a temperature of 143±2° C.

The core impregnation can be carried out off-line in a standard impregnation system or inline inside the paper machine with the aid of usual application units.

In a further embodiment of the invention, the ink-receiving layer can also be applied to the core-impregnated paper without pre-drying.

In a further embodiment of the invention, the ink-receiving layer can also be applied to a multiple impregnated resin-impregnated paper (a conventional decorative paper impregnate).

In a particular embodiment of the invention, the decorative paper impregnate has a reactivity of 2 to 3 minutes at a temperature of 140° C. and a pressure of 25 bar.

The decorative paper impregnate produced in this way can be rolled up in the system or divided into sheets. The decorative paper can then be printed in high quality using various ink jet methods. After the printing, the paper is hot pressed onto a wood-based board or to form a laminate in a coating press. For this purpose resin-impregnated paper (underlay) as composite layer or any other adhesive layer is no longer required. However, a resin-impregnated underlay can be additionally used if desired. A resin-impregnated overlay can be applied as a protective layer before pressing. However, the printed product can also be sealed first with a varnish.

The decorative base papers which can be used according to the invention are those which have not undergone any sizing in the mass nor any surface sizing. They substantially consist of cellulose, pigments and fillers and usual additives. Usual additives can be wet strength additives, retention aids and fixing aids. Decorative base papers differ from the usual papers by the very much higher filler fraction or pigment content and the lack of any mass sizing or surface sizing which is usual in paper.

Softwood cellulose, hardwood cellulose or mixtures of both types of cellulose can be used to produce the decorative base papers. It is preferable to use 100% hardwood cellulose. However, mixtures of softwood/hardwood cellulose in the ratio of 5:95 to 50:50, in particular 10:90 to 30:70 can also be used. The base papers can be produced on a Fourdrinier paper machine or a Yankee paper machine. For this purpose the cellulose mixture having a stock consistency of 2 to 5% by weight can be refined to a freeness of 10 to 45° SR. In a mixing vat fillers and/or pigments, colour pigments and/or dyes as well as wet strength additives such as polyamide/polyamine epichlorohydrin resin, cationic polyacrylates, modified melamine formaldehyde resin or cationised starches can be added in the usual quantities for the manufacture of decorative papers and blended thoroughly with the cellulose mixture.

The fillers and/or pigments can be added in a quantity of up to 55% by weight, in particular 10 to 45% by weight, relative to the weight of the cellulose. Suitable pigments and fillers are, for example, titanium dioxide, talc, zinc sulphide, kaolin, aluminium oxide, calcium carbonate, corundum, aluminium and magnesium silicates or mixtures thereof.

The high consistency matter produced in the mixing vat can be diluted to a stock consistency of about 1%. If necessary, further adjuvants such as retention aids, defoamers, dyes and other previously named adjuvants or mixtures thereof can be added. This low-consistency matter is passed via the head box of the paper machine to the wire section. A fibre fleece is formed and after dewatering the base paper is obtained which is then further dried. The basis weights of the papers produced can be 30 to 200 g/m$^2$.

Depending on the application and the quality requirements, the decorative base papers used according to the invention can be constituted as follows:

smooth, i.e. having a Bekk smoothness of more than 80 s, unsmoothed, less than 80 s, smoothed with a Yankee cylinder or with a calender, not pre-impregnated or pre-impregnated with a synthetic resin, very air-permeable (Gurley values below 20 s/hml) or dense (Gurley values above 20 s/hml) or even in the case of the pre-impregnates, extremely dense with Gurley values above 200 s/hml.

The decorative paper according to the invention can be coloured. Inorganic colour pigments such as metal oxides, hydroxides and oxide hydrates, metal sulphides, sulphates, chromates and molybdates or mixtures thereof, as well as organic colour pigments and/or dyes such as carbonyl colorants (e.g. quinones, quinacridone), cyanine colorants, azo colorants, azomethines and methines, phthalocyanines or dioxazines can be used for colouring. Particularly preferred are mixtures of inorganic colour pigments and organic colour pigments or dyes. The quantity of the colour pigment/pigment mixture or dye/dye mixture can be 0.0001 to 5% by weight relative to the mass of cellulose depending on the type of substance.

All known receiving layers can be used for the ink receiving layer. In this case, these mostly comprise hydrophilic coatings containing water-soluble or water-dispersible polymers.

The ink receiving layer can additionally contain fillers, pigments, dye-fixing substances such as quaternary polyammonium salts and other adjuvants usually used in such layers. A suitable quaternary polyammonium salt is polydiallyl dimethylammonium chloride.

In a preferred embodiment of the invention the ink-receiving layer contains a pigment and a binder in a quantitative ratio of 10:90 to 90:10. The quantity of the pigment in the ink receiving layer is preferably 5 to 80% by weight, but in particular 10 to 60% by weight relative to the dry weight of the layer.

The pigment can be any pigment usually used in ink jet recording materials, but in particular aluminium oxide, aluminium hydroxide, boehmite and silica (such as precipitated or pyrogenically generated silica).

The binder can be a water-soluble and/or water-dispersible polymer, for example, polyvinyl alcohol, polyvinyl pyrrolidone, polyvinyl acetate, starch, gelatine, carboxymethyl cellulose, ethylene/vinyl acetate-copolymer, styrene/acrylic acid ester copolymers or mixtures thereof. A polyvinyl alcohol having a degree of saponification of 88 to 99% can be used as the polyvinyl alcohol.

In a particular embodiment of the invention, the ink-receiving layer can be coloured. The colouring can be accomplished with the same colour pigments and/or dyes used to colour the base paper. The quantity (concentration) of the colour pigment and/or dye in the ink receiving layer relative to the dried ink receiving layer is preferably about 45 to 75%, in particular 45 to 65% of the quantity of colour pigment and/or dye in the base paper, relative to the cellulose (atro).

The application weight of the ink-receiving layer can be 2 to 25 g/m$^2$, in particular 3 to 20 g/m$^2$, but preferably 4 to 15 g/m$^2$. The ink receiving layer can be applied with the usual application methods such as roller application, slotted nozzle application, gravure or nip methods, curtain coating, air brushing or metering bar.

Suitable impregnating resins are the impregnating resins usually used in this technical field, in particular melamine formaldehyde resin, urea formaldehyde resin, phenol formaldehyde resin, polyacrylates, acrylic acid ester/styrene copolymers and mixtures thereof. Particularly suitable are so-called "slow" impregnating resins which have a clouding time of more than 4.5 minutes. The clouding time is the time in which a resin at a temperature of 100° C. shows a first clouding which signals the beginning of the polymerisation reaction.

The impregnating resin is used in a quantity of 40 to 250% by weight, preferably 80 to 125% by weight, of the basis weight of the decorative base paper.

EXAMPLES

Example 1

A cellulose suspension was prepared by pulping a cellulose mixture of 80% by weight eucalyptus cellulose and 20% by weight of pine sulphate cellulose at a stock consistency of 5% to a freeness of 33° SR. This was then followed by the addition of 1.8% by weight of epichlorohydrin resin as wet strength additive. This cellulose suspension was adjusted to a pH of 6.5 to 7 by means of aluminium sulphate. A mixture of 40% by weight of titanium dioxide and 5% by weight of talc, 0.11% by weight of a retention aid and 0.03% by weight of a defoamer was then added to the cellulose suspension and a decorative base paper having a basis weight of 81 g/m$^2$ and an ash content of about 32% by weight was prepared. The weight specification relates to the cellulose.

In the next step a coating mixture was prepared for the ink receiving layer having the following composition:

| | |
|---|---|
| Water | 80% by weight |
| Boehmite | 10% by weight |
| Polyvinyl alcohol | 5% by weight |
| Polyvinyl acetate | 4% by weight |
| Quat. polyammonium salt | 1% by weight |

The decorative base paper produced was acted upon by a "slow" resin in the first stage of a usual decorative paper impregnating system and after the penetration phase, was immersed and then only moderately squeezed so that a small resin film remains on the surface of the paper. A pure melamine formaldehyde resin having a solid content of 51% and a clouding time of 4.5 minutes was used as resin.

The core-impregnated paper was dried to a moisture of 12%. The basis weight of the paper after impregnation was 139 g/m$^2$.

The pre-dried core-impregnated paper was then coated with the ink jet ink receiving layer described in detail above with an application weight of 6 g/m$^2$ and dried to a final moisture of 6.3%.

The dried decorative paper impregnate had a basis weight of 140 g/m$^2$ and a thickness of 133 μm.

The reactivity of the impregnating resin in the dried decorative paper impregnate was 2.5 minutes. The degree of cross-linking was 29%.

The flow of the decorative paper impregnate according to the invention was 1.2%.

The decorative paper impregnate produced according to Example 1 was printed in an ink jet printer (HP 2500 with pigmented inks) and divided into DIN A4 sheets. These sheets were placed on a chipboard, covered with an overlay film (paper having a basis weight of 35 g/m$^2$ which was resin-impregnated to 116 g/m$^2$) and hot pressed. The pressing was carried out at a temperature of 140° C. and a pressure of 25 bar.

Example 2

A cellulose suspension was prepared by pulping 100% by weight eucalyptus cellulose at a stock consistency of 5% to a freeness of 33° SR. This was then followed by the addition of 1.8% by weight of epichlorohydrin resin as wet strength additive. This cellulose suspension was then adjusted to a pH of 6.5 to 7 by means of aluminium sulphate. A mixture of 36% by weight of titanium dioxide and 5% by weight of talc, 0.11% by weight of a retention aid and 0.03% by weight of a defoamer was then added to the cellulose suspension and a decorative base paper having a basis weight of about 80 g/m$^2$ and an ash content of about 30% by weight was prepared from this. The weight specification relates to the cellulose.

The decorative paper produced was acted upon by a "slow" resin in the first stage of a usual decorative paper impregnating system and after the penetration phase, was immersed and then only moderately squeezed (as in Example 1). The resin is a pure melamine formaldehyde resin having a solid content of 51% and a clouding time of 5.5 minutes. The core-impregnated paper was dried to a moisture of 13%. The basis weight of the paper after impregnation was 162 g/m$^2$.

The pre-dried core-impregnated paper was then coated with the ink jet ink receiving layer described in detail above with an application weight of 7 g/m$^2$ and dried to a final moisture of 6.5%.

The dried decorative paper impregnate had a basis weight of 160 g/m$^2$ and a thickness of 149 μm. The reactivity of the impregnating resin in the dried decorative paper impregnate was 3.5 minutes. The degree of cross-linking was 26%. The flow of the decorative paper impregnate was 1.5%.

The decorative paper impregnate according to Example 2 was printed in an ink jet printer (HP 2500 with pigmented inks) and divided into DIN A4 sheets. These sheets were placed on achipboard, covered with an overlay film as in Example 1 and hot pressed. The pressing was carried out at a temperature of 140° C. and a pressure of 25 bar.

The laminated boards produced with the aid of the decorative papers according to the invention exhibit properties of a high-quality melamine coating. They are distinguished by a closed surface which is free from bubbles and discolorations in a water vapour test. The surface is also resistant to the action of chemicals in accordance with the standard EN 438 for laminated boards.

The following advantages are additionally associated with the procedure according to the invention:

- Even short web lengths of a few linear metres can be fully through-impregnated. Usually in an industrial synthetic resin impregnation at least an entire impregnating system length is used as a forerun for drawing in and monitoring the settings, which in numbers means 50 to 100 meters.
- Since the decorative paper according to the invention is only printed after the core impregnation of the paper web, the expensive and sensitive printing is not endangered by the impregnation process.
- When printing with aqueous printing inks, the paper product according to the invention becomes less wavy due to swelling because the paper structure is stabilised by the resin.
- On account of the stiffness, it is easier to equip a press with impregnated papers than is the case with an unimpregnated base paper during a conventional pressing between two resin-impregnated papers.
- A processing stage is eliminated compared with a subsequent impregnation which leads to significant cost advantages.
- The laminate manufacturer can individually print each quantity of decorative paper required without needing to have his own impregnating equipment. For this purpose an ink jet printing equipment can be set up in the vicinity of a laminate press. Due to the decoupling of printing and impregnation, the general logistics for the product is improved and the usage of material is optimised.

TEST METHODS USED

Testing the Flow of an Impregnate

The flow is tested by determining the flow behaviour of the resin of the impregnating-resin impregnated decorative paper (impregnate). For this purpose five disks having a diameter of 4 cm are punched from an impregnate sample. These are pressed between an aluminium foil for 5 minutes (Wickert and Söhne precision press, 120×120 cm, pre-pressure: 46 bar/12 seconds, main pressure: 180 bar/12 seconds at 143±2° C.) After the pressing process the disk laminate is cooled and weighed (initial weight). After removing the resin which has flowed out of the disk (the amount of resin located at the side of the blank), the laminate is weighed again (final weight). The difference between the initial and final weight, related to the weight of the original disk laminate, gives the flow of the impregnate.

$$\text{Flow} = \frac{\text{Initial weight (g)} - \text{final weight (g)}}{\text{Initial weight (g)}} \times 100$$

Reactivity of the Resin

The reactivity is the minimum pressing time required at a specific temperature (e.g. 140° C.) during which the surface is cured so much that a contaminant with the dye Rhodamine B can easily be removed with water.

Degree of Cross-Linking of the Resin

The degree of cross-linking is the quantity of impregnated resin which cannot be dissolved from the sample after dipping for 35 minutes in DMF (dimethyl formamide) at room temperature.

Residual Moisture of an Impregnate

To this end circular samples (F 40 mm) are punched out and initially conditioned at 23° C., 50% room humidity, and weighed out. The weighed-out sample is dried for 5 minutes in a drying cabinet at 160° C. The residual moisture is calculated as follows:

$$\text{Residual moisture (\%)} = \frac{\text{Initial weight (g)} - \text{final weight (g)}}{\text{Initial weight (g)}}$$

Reactivity of the Resin

The test is used to determine the time curing behaviour of impregnated decorative papers.

To this end several circular samples having a diameter of 4 cm are punched out. These samples are then placed between the shiny sides of an aluminium film (thickness: 0.030 mm) and the package is placed in the middle of a heated press (Wickert and Söhne, pressing area 120 mm×120 mm, pre-pressure setting 46 bar for 12 seconds, main pressure setting 180 bar from 12 seconds, temperature setting 140° C.). The press is started and the pressing program runs. The curing time defaults are 20 to 600 seconds in steps of 5 seconds (at the beginning) to 120 s (at the end).

After the pressing program has expired, the test specimens are immediately cooled between two sheets to stop the curing reaction.

After cooling to 5 to 65° C., the test specimens are immersed for three minutes in a 0.025% aqueous rhodamine B solution at a temperature of 95° C. and then for 15 seconds in cold water. After drying with soft paper towels, the samples are glued onto a transparent film after increasing pressing times. The assessment is made visually with respect to the reference sample. The reactivity value is achieved when the test specimens are only minimally coloured and no further change can be achieved due to longer pressing times.

Degree of Cross-Linking

The test is used to determine the degree of curing of impregnates.

For this purpose test specimens having an area of 100 $cm^2$ are punched out and weighed (corresponds to sample weight "before extraction"). The test specimens are then dipped in N,N-dimethyl formamide (DMF) (100 $cm^2$ disks in 100 ml). After an exposure time of 30 to 35 minutes at room temperature, the test specimens are removed, placed on blotting paper and then dried in a drying cabinet at 120° C. for 90 minutes. After cooling the test specimens are weighed (corresponds to sample weight "after extraction").

Evaluation:

Dissolved fractions (g)=initial weight (g)−final weight (g)

Dissolved fractions (%)=dissolved fractions (g)/initial weight (g)×100

Cross-linked fractions (%)=final weight (g)/initial weight (g)×100

Initial weight (g)=sample weight "before extraction" (g)−basis weight of base paper ($g/m^2$)×sample area ($cm^2$)/10,000

Final weight (g)=sample weight "after extraction" (g)−basis weight of base paper ($g/m^2$)×sample area ($cm^2$)/10,000

We claim:

1. Decorative paper impregnate for decorative coating materials which contains an impregnated base paper and an ink receiving layer, comprising a base paper which contains an impregnating resin in a quantity of 40 to 250% by weight of the basis weight of the base paper, after drying said decorative paper impregnate has a residual moisture of at least 3.5% by weight and a resin flow of more than 0.4%, measured at a pressure of 180 bar and a temperature of 143±ft.

2. The decorative paper impregnate according to claim 1, wherein the impregnating resin is contained in a quantity of 80 to 125% of the basis weight in the base paper.

3. The decorative paper impregnate according to claim 1, wherein the impregnating resin is a melamine formaldehyde resin, a urea formaldehyde resin, an acrylate resin or a mixture of these resins.

4. The decorative paper impregnate according to claim 1, wherein the impregnating resin is still reactive after drying the decorative paper impregnate.

5. The decorative paper impregnate according to claim 1, wherein the ink-receiving layer contains a pigment and a binder in a quantitative ratio of 10:90 to 90:10.

6. The decorative paper impregnate according to claim 5, wherein the binder of the ink-receiving layer is a water-soluble and/or a water-dispersible polymer.

7. The decorative paper impregnate according to claim 5, wherein the pigment can be an aluminium oxide, aluminium hydroxide, boehmite and/or silica.

8. The decorative paper impregnate according to claim 1, wherein the application weight of the ink-receiving layer is 2 to 25 $g/m^2$.

* * * * *